US005322234A

United States Patent [19]

Robert et al.

[11] Patent Number: 5,322,234

[45] Date of Patent: Jun. 21, 1994

[54] TELESCOPING CORE PLUG AND SUPPORT THEREFOR

[75] Inventors: Craig E. Robert, Hickory, N.C.; Michael J. Seckler, Wapdingers Falls, N.Y.; Brian K. Farison, New Milford, Conn.

[73] Assignee: Sealed Air Corporation, Saddle Brook, N.J.

[21] Appl. No.: 129,785

[22] Filed: Jun. 29, 1993

Related U.S. Application Data

[63] Continuation of Ser. No. 843,722, Feb. 28, 1992, abandoned.

[51] Int. Cl.[5] ..... B65H 16/02

[52] U.S. Cl. ..... 242/68.6; 242/55.2

[58] Field of Search ..... 242/68.4, 68.5, 68.6, 242/68.2, 55.2, 55.53, 68, 55.3

[56] References Cited

U.S. PATENT DOCUMENTS

| | | | |
|---|---|---|---|
| 1,098,864 | 6/1914 | Wheeler | 242/55.2 |
| 1,579,769 | 4/1926 | Jones | 242/68.4 |
| 3,156,425 | 11/1964 | Mynchemberg | 242/55.53 |
| 3,601,328 | 8/1971 | McClung . | |
| 3,627,220 | 12/1971 | Vogel | 242/68.6 |
| 4,032,077 | 6/1977 | Baselice . | |
| 4,171,781 | 10/1979 | Kral et al. . | |
| 4,191,342 | 3/1980 | Reinhold . | |
| 4,383,656 | 5/1983 | Campbell | 242/55.2 |
| 4,522,346 | 6/1985 | Jespersen | 242/55.3 |
| 4,600,162 | 7/1986 | Hidle . | |
| 4,618,995 | 10/1986 | Kemp . | |

FOREIGN PATENT DOCUMENTS

| | | | |
|---|---|---|---|
| 647062 | 7/1928 | France | 242/68.4 |

*Primary Examiner*—William A. Cuchlinski, Jr.
*Assistant Examiner*—Alvin Wirthlin
*Attorney, Agent, or Firm*—Bell, Seltzer, Park & Gibson

[57] ABSTRACT

A roll support system for supporting a roll of web material is provided which includes a mechanism for retaining and easily releasing a roll of web material wound around a core and having a telescoping core plug adapted to snugly fit in each end of the core. A core plug is provided with a telescoping spindle biased toward its extended position to support a roll in the support mechanism.

12 Claims, 4 Drawing Sheets

TELESCOPING CORE PLUG AND SUPPORT THEREFOR

This is a continuation of co-pending application Ser. No. 07/843,722 filed on Feb. 28, 1992, now abandoned.

FIELD OF THE INVENTION

This invention relates to a core plug for supporting the end of a roll of web material during unwinding and to a quick release mechanism for securing the core plug in a roll support. More particularly, this invention relates to a core plug having a telescopically mounted spindle and means for biasing the spindle toward its extended position and to a mechanism for receiving and holding a telescoping core plug.

BACKGROUND OF THE INVENTION

Paper and packaging material are often produced in roll form wrapped around a central core. When being dispensed the roll is mounted on a support and unwound as it is used. The core is supported by a core plug at each end of the roll core. Core plugs come in a variety of shapes and sizes. Although the main purpose of a core plug is the support of a roll of wound web material, core plugs also serve a variety of other purposes.

It is important that the web material be unwound evenly and smoothly from the roll. Dispensing of paper or packaging material in roll form often presents problems in smooth unwinding such as uneven tension across a web caused by an off center positioning of the rolled material, or even in the roll becoming unseated from its support.

Another example of problems occurring during unwinding is that the roll core may become deformed resulting in uneven turning of the roll. Also, when a roll is supported on a single shaft running the axial length of the core the turning of a roll having a deformed core is uneven and jerky. These effects of uneven dispensing are often enlarged when the roll is large and heavy. Additionally, it is important that the roll of web material be securely retained in the roll support and yet be easily and quickly removed therefrom for replacement with a new roll of web material. Many of the attempts to eliminate these problems result in ineffective, cumbersome or costly solutions.

Thus, there exists the need for a simple and economical device for supporting a roll of web material and securing the roll in place.

SUMMARY OF THE INVENTION

It is therefore an object of the present invention to overcome the problems set forth above by the provision of a core plug which permits a roll of web material to be securely supported during unwinding and easily placed into and removed from the support.

Another object of the present invention is to provide a core plug having a telescoping spindle for easy placement into and out of a roll support.

Yet another object of the present invention is to provide a mechanism for securely retaining and quickly releasing a telescoping core plug.

Still another object of the present invention is to provide a core plug having a spring loaded telescoping spindle for compensating in roll core length variations and/or roll support frame width variations.

A roll support system for supporting a roll of web material is provided which includes a mechanism for retaining and quickly releasing a roll of web material wound around a core and having a telescoping core plug in each end of the core.

The core plug according to this invention has a generally cylindrical body portion adapted to fit snugly within the end of a core about which web material is wound. The body portion has an axial opening of predetermined diameter extending longitudinally therethrough. The retention feature of the plug is illustrated by a spindle member telescopically mounted in said axial opening in said body portion for movement between extended and retracted positions and including a supporting end portion projecting beyond the outer end of the body portion. The supporting end portion of the core plug is shaped to be received in a roll support stand when the core plug is placed within the end of the core of a roll of material. The core plug contains a spring biasing means urging the spindle member toward its extended position.

To most efficiently utilize the telescoping core plug of this invention it is desirable to have a support mechanism that securely holds the telescoping core plug in place and yet quickly and easily allows for removal of the core plug. A mechanism is provided for quickly releasing a core plus which includes a core plug chute having a channel for easily receiving and removing the core plug. There is also provided a seating member integral with one end of the channel. The seating member has an axial opening of predetermined diameter extending longitudinally therethrough. The axial opening is adapted to receive a core plug when a roll of web material is placed in the mechanism and moved into position. A plunger is telescopically mounted in the axial opening for movement between extended and retracted positions and including an end portion projecting beyond the outer end of the seating member and spring biasing means biasing the plunger toward its extended position to maintain the core plug spindle securely in place. When the core is removed the plungers on each side are moved inwardly until they catch thereby pushing the support portion of the spindle inwardly making the core easily removable.

BRIEF DESCRIPTION OF THE DRAWINGS

Other objects, features, and advantages of the present invention will become more apparent from the following detailed description of the invention when taken in conjunction with the accompanying drawings, in which.

DETAILED DESCRIPTION OF THE INVENTION

A roll support system for supporting a roll of web material wound around a core is provided which broadly includes a roll support mechanism 30 and a telescoping core plug 10 which supports the roll of web material in the support mechanism during unwinding.

Figure 1:
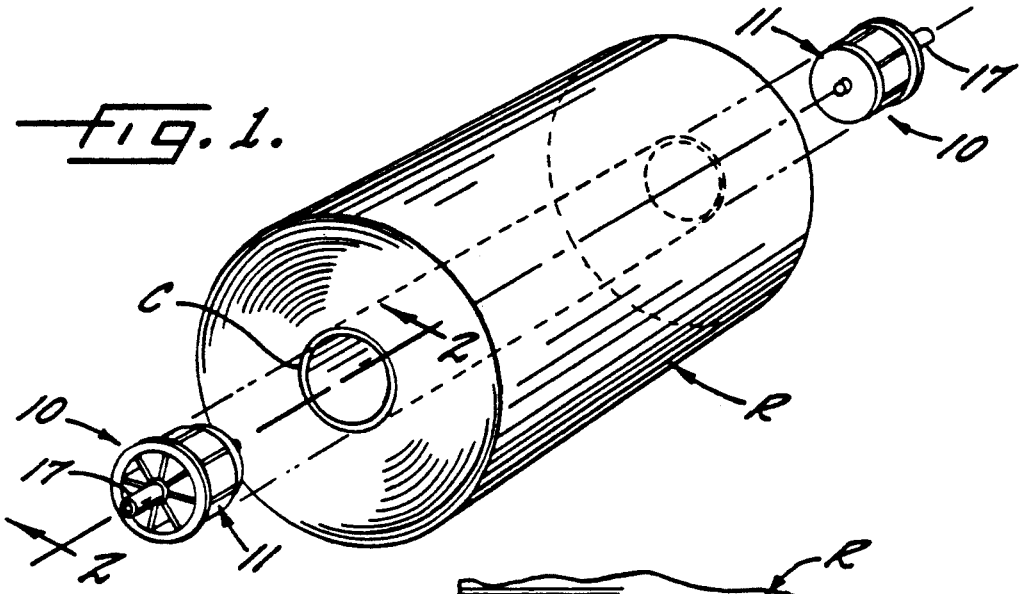
FIG. 1 is an isometric view of the core plug of this invention as it is placed into the core of a roll of web material.
Figure 5:
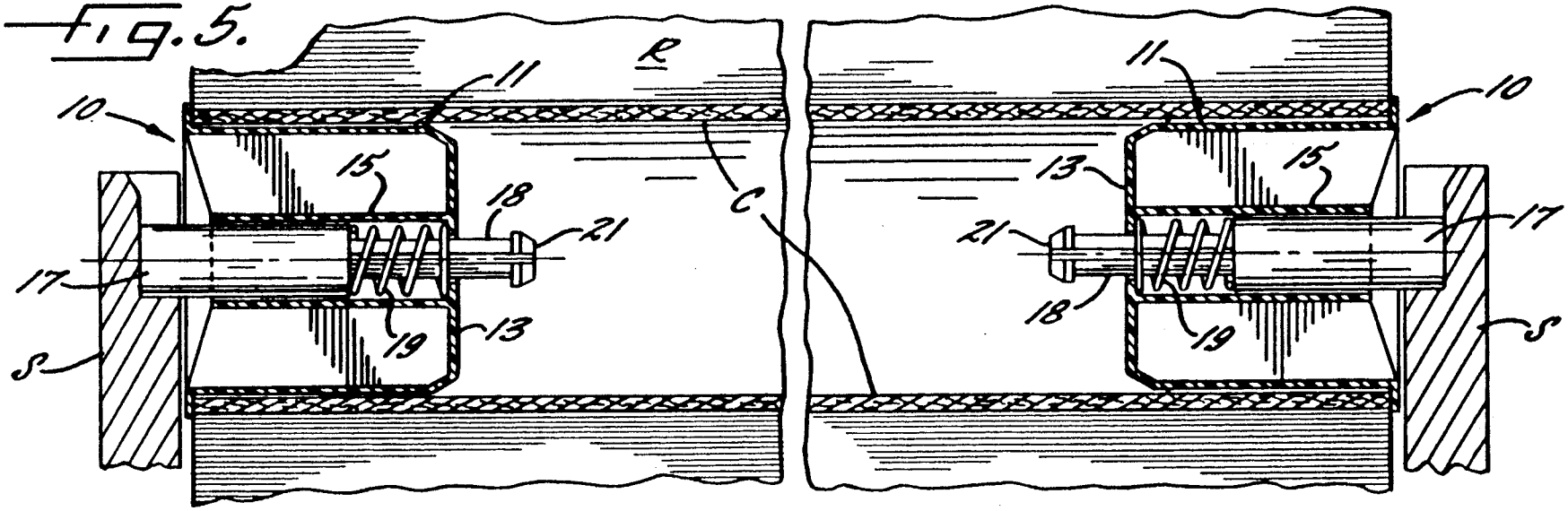
FIG. 5 is a cut away front view of a typical core have a core plug inserted in each end of the core and resting in a roll support.

Referring now more specifically to the drawings, there is shown in FIG. 1 a roll of web material R and having a core C, shown in dotted lines, about which the web material is wound and a core opening into which a core plug can be placed. In the illustrated embodiment there is shown a pair of identical core plugs according to this invention, generally indicated at 10, which support roll R during unwinding of the web material. Another illustration of the present invention is shown in FIG. 5 where the core plugs are shown in an engaged position resting is a support S. The details of the core plug are shown more clearly in FIG. 2 wherein core plug 10 comprises a generally cylindrical body 11 having a diameter corresponding substantially to the internal diameter of the core C and adapted to fit snugly therein. Cylindrical body 11 may be a substantially hollow, cup-shaped body, open at its outer end, formed by a thin circumferential side wall 12 and an end wall 13 at its closed end. Circumferential side wall 12 may be surrounded at its outer end by annular flange 14 which serves to keep core plug 10 from being inserted to far into core C. As shown in FIG. 3 cylindrical body portion 11 may have raised ribs 21 to assist in assuring a snug fit of the core plug into core C.

Figure 2:
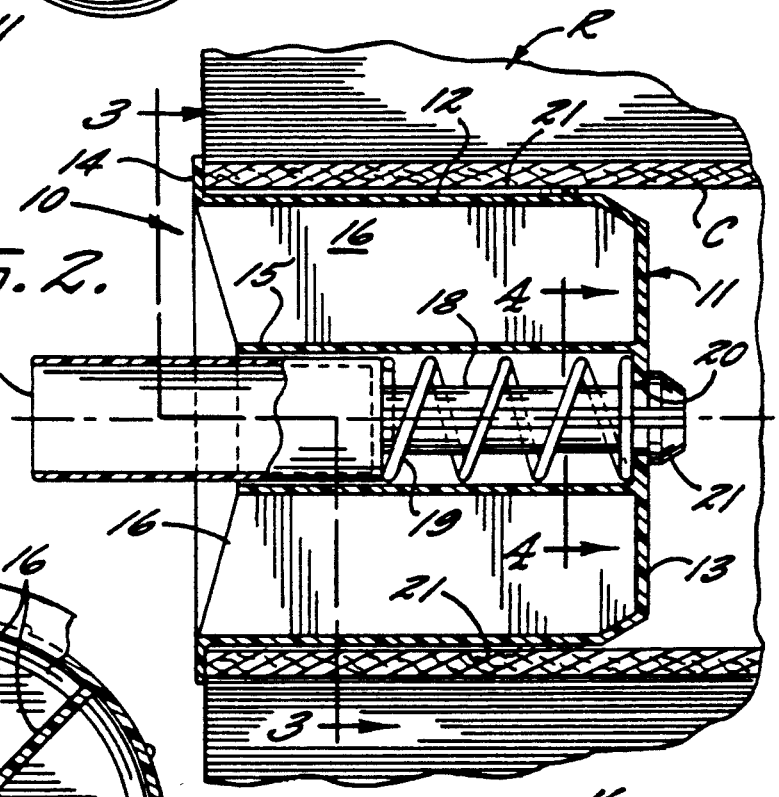
FIG. 2 is a section view taken along line 2—2 of FIG. 1 showing the details of the core plug of this invention.
Figure 3:
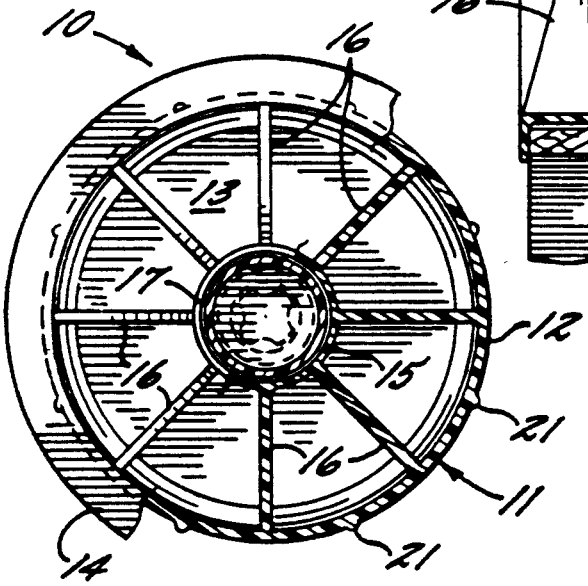
FIG. 3 is a partial sectional end view of the core plug of this invention taken along line 3—3 of FIG. 2.

Body portion 11 has an axial opening of predetermined diameter extending longitudinally through the cylindrical body and it end wall 13 as shown in FIG. 2. Hollow core plug body portion 11 has a hub portion 15 through which the axial opening extends. The hub portion 15 may be formed integral with end wall 13 and extending therefrom substantially to the outer end of body portion 11. As shown in FIG. 3 there may be a plurality of spokes 16 connecting and supporting hub 15 to side wall 12. Cylindrical body portion 11 may be made of injection molded plastic material.

As may be seen in FIG. 2 there is shown a spindle member comprising supporting portion 17 and inward end portion 18. The spindle member is telescopically mounted in the axial opening formed in hub 15 for movement between extended and retracted positions. Supporting end portion 17 projects beyond the outer end of said body portion 11 and preferably has a diameter closely conforming to the predetermined diameter of the axial opening for a snug fit therein while still allowing relative movement. When the spindle member is in its extended position the supporting end portion 17 is adapted to be received in a roll support when core plug 10 is placed within the end of the core C of a roll of material for supporting one end of the roll during unwinding. The inward end 18 of spindle member extends through the axial opening 20 in end wall 13 and has a smaller diameter than the supporting end portion 17, sufficiently small to accommodate spring means 19.

Figure 4:
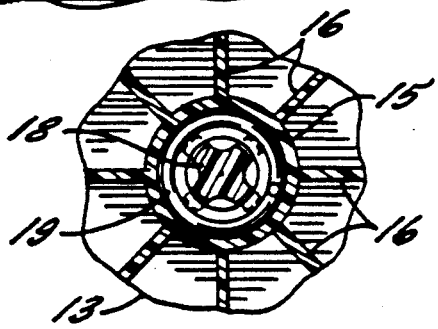
FIG. 4 is a partial section of the core plug of this invention taken along line 4—4 of FIG. 2.

The spring means 19 biases the spindle member toward its extended position as shown in FIGS. 2 and 5. The spring means is preferably a coil spring 19 mounted on the smaller diameter inward end portion 18 of the spindle member between the supporting end portion 17 and the end wall 13 of cylindrical body 11. As shown in FIGS. 2 and 4 the spindle is maintained in the axial opening of hub 15 by knob 21. Although knob 21 may be of various designs, a design such as shown in FIG. 4 is preferred so that assembly into axial opening 20 of end wall 13 may be made with no additional parts.

Figure 6:
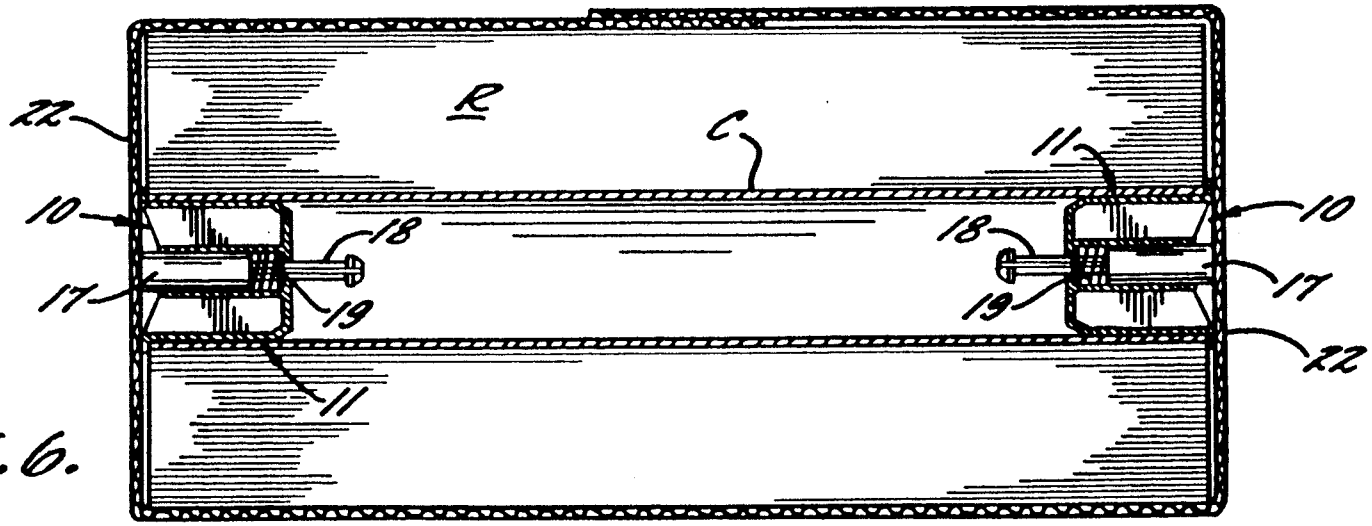
FIG. 6 illustrates a roll of web material having a core plug of the present invention inserted in each end of the core and wrapped for shipping.

The core plugs may be and preferably are inserted into the core prior to the roll of web material being wrapped for shipping, are shown in FIG. 6. When a roll is wrapped for shipping the outwardly biased spindle is pushed inwardly by the outer wrap 22 around the roll.

Figure 7:
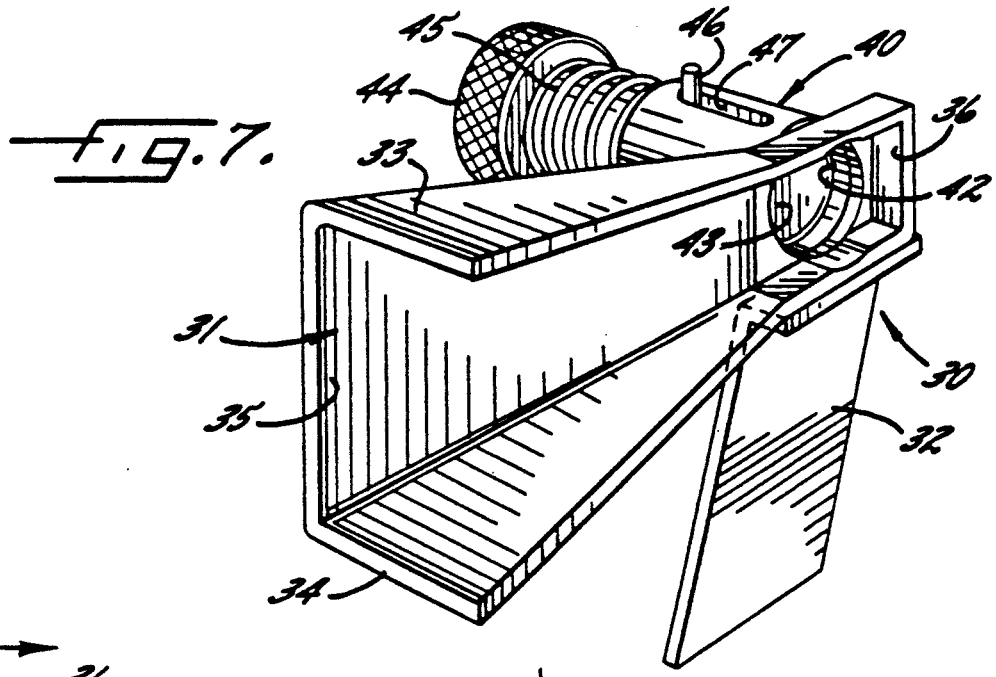
FIG. 7 is a perspective view of the core plug receiving chute and quick release mechanism of this invention.
Figure 8:
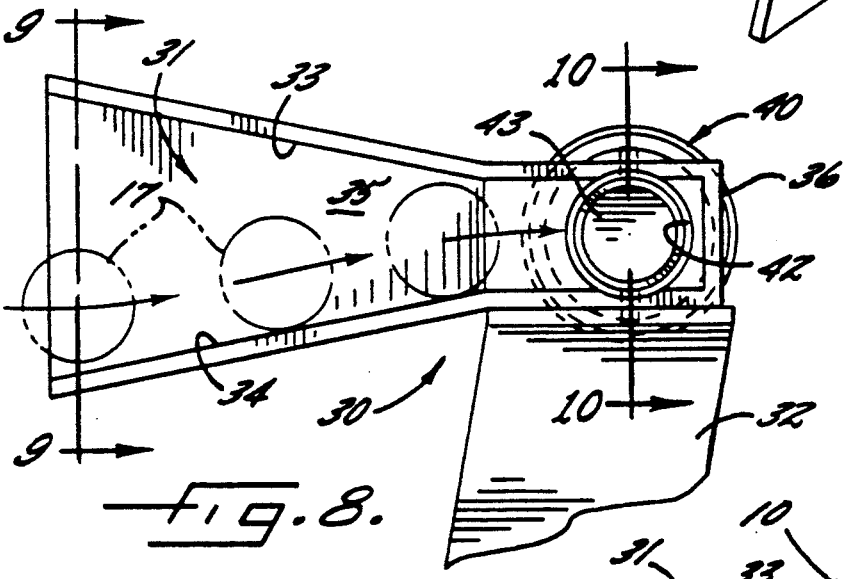
FIG. 8 illustrates a side elevation view of the core plug receiving chute of this invention.

The supporting end portion 17 is adapted to be received in a roll support when the cylindrical body 11 of core plug 10 is placed with the end of the core C of a roll of web material. The core plugged roll may be used with almost any type of support stand but they are most effectively used with the support mechanism hereinafter described. As illustrated in FIGS. 7 and 8 a roll support mechanism, generally described at 30, is provided for supporting a roll of web material. The roll support mechanism 30 comprises chute 31 for easily accommodating a roll having core plugs inserted in each end of the core, and seating member 40 for maintaining the roll of web material in a secured position and for easily releasing the core plugs.

Chute 31 comprises a channel for receiving a core plug, formed of top and bottom members 33, 34 and back member 35 for receiving a core plug. The rear of chute 31 has a backstop 36 formed integrally with the channel top and bottom to prevent any roll from accidentally being passed through the channel. The chute is preferably wider at its front end to more easily align the roll of web material as shown in FIG. 8. The roll support mechanism 30 is attached to stand support 32. There is preferably a similar chute on the other side of the roll support. The roll of web material is placed in the open end of chute 31 and moved forward along and within the channel toward seating member 40 which is integrally formed with and through back member 35 of the closed end of chute 31.

Figure 9:
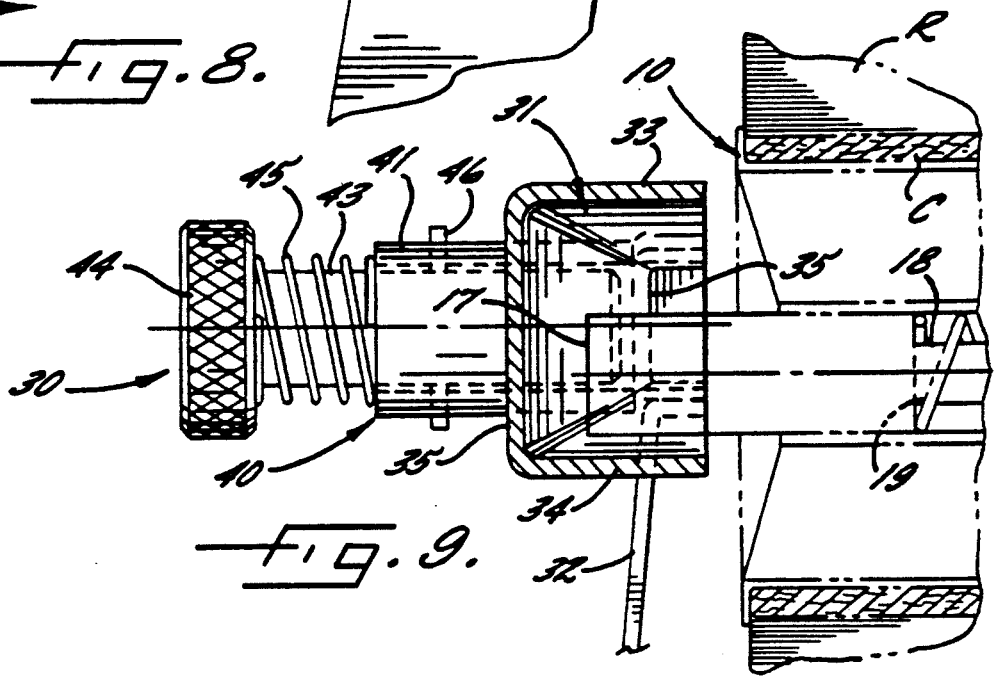
FIG. 9 is a section view of the core plug receiving chute and quick release mechanism taken along line 9—9 of FIG. 8.
Figure 10:
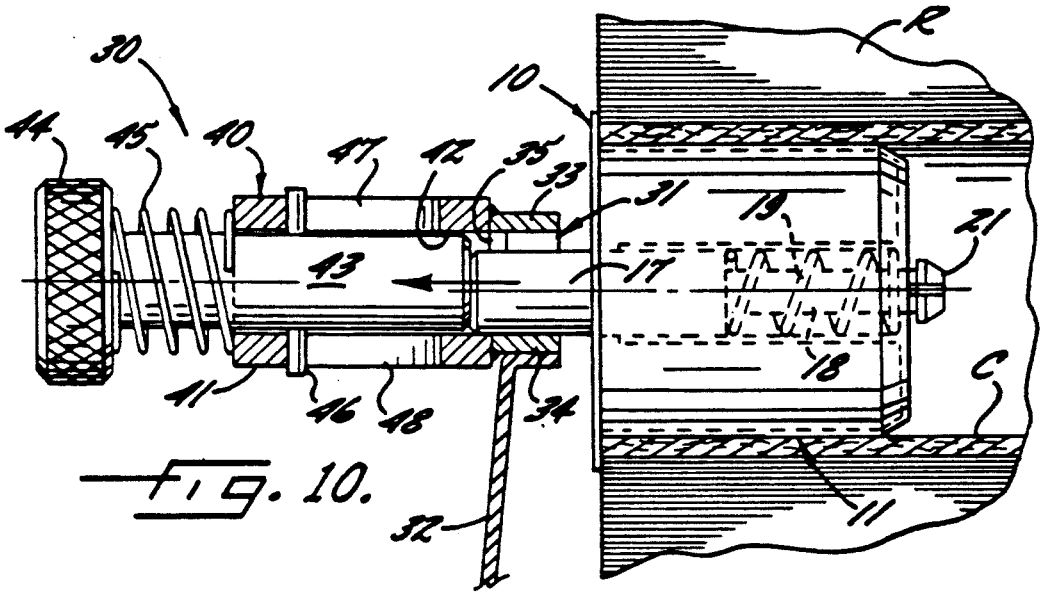
FIG. 10 is a partial sectional view taken along line 10—10 in FIG. 8 and illustrating the core plug support of this invention in its engaged position.
Figure 11:
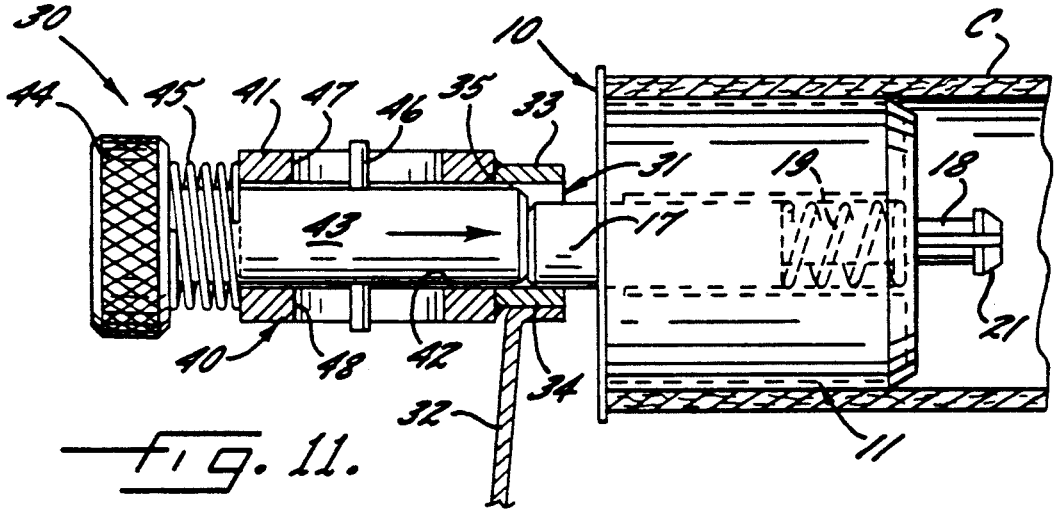
FIG. 11 is a partial sectional view illustrating the core plug of this invention in its released position.

As shown in FIGS. 9–11 seating member 40 comprises a body portion 41 having an axial opening 42 of predetermined diameter extending longitudinally through the seating member 40 and the back wall 35 of chute 31. The axial opening 42 is adapted to receive the roll support portion 17 of core plug 10. A plunger member 43 is telescopically mounted in the axial opening in seating member 40 for movement between its retracted position shown in FIG. 10 and its retracted position shown in FIG. 11. Plunger member 43 including an end portion thereof projecting beyond the outer end of seating member 40. The outer end of plunger member 43 is capped with knob 44 which holds spring means 45 in place around the outer portion of plunger member 43 and biases the plunger member toward its retracted position.

Plunger member 43 has a travel limiting pin 46 extending therethrough and extending through oppositely disposed openings 47, 48 of seating member body portion 41. The openings 47, 48 extend longitudinally along body portion 41 which is mounted to back member 35 of chute 31 and serve to limit the movement of pin 46 thereby holding plunger member 43 in its proper place.

Figure 12:
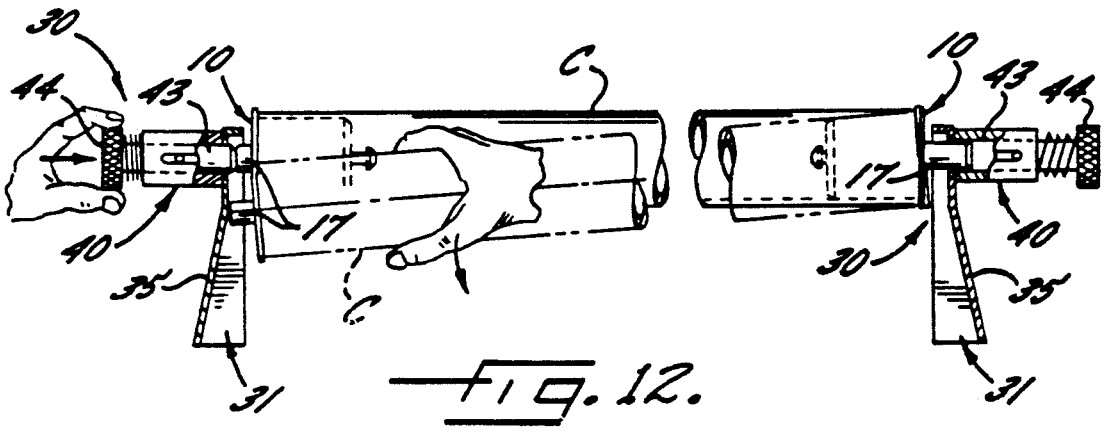
FIG. 12 is a schematic top plan view of the core plug being removed from its support structure.

In operation a roll of packaging material R wound around a core C has a telescoping core plug 10 placed snugly in each end of core C. The roll R is placed in chute 31 of the roll support mechanism 30 (FIG. 9) and moved forward until it is in front of seating member 40 (FIG. 10) whereupon the spring biasing means 19 of the core plugs 10 pushes spindles outwardly into the axial opening of seating member 40. The positioning of the spindle in the axial opening 42 of seating member 40 is aided by the upwardly and inwardly ramped portions 34, 35 of the chute 31. The spindle is securely seated after alignment of the core plug spindle with the axial opening 42 of the seating members 40, as shown in FIG. 10. When the roll is empty, or it is desirable to remove the roll for other reasons, the plunger 43 is simply pushed inwardly against the spring force (FIG. 11). In doing so the outer portion 17 of the core plug spindle is pushed inwardly and the core C is easily and quickly removed from the support mechanism. As illustrated in FIG. 12, the removal of the core may be accomplished by engagement of just one of the plungers 43 located on either side of the support mechanism.

The invention has been described in detail with particular reference to a preferred embodiment and the operation thereof, but it is understood that variations, modifications, and the substitution of equivalent means can be effected within the spirit and scope of this invention.

We claim:

1. A core plug for supporting one end of a roll of web material during unwinding comprising a generally cylindrical body portion having a circumferential side wall and an end wall formed integral with said side wall having a plurality of raised ribs on the outside of said sidewall and adapted to fit snugly within the end of a core about which the web material is wound said raised ribs assisting in assuring a snug fit of the core plug, said body portion including a hub portion formed integral with said end wall having an axial opening of predetermined diameter extending longitudinally through said hub portion and said end wall, a spindle member telescopically mounted in said axial opening in said body portion for movement between extended and retracted positions including a supporting end portion thereof projecting beyond the outer end of said body portion when said spindle member is in its extended position and being completely inside the core plug body when retracted, said supporting end portion being adapted to be received in a roll support when said core plug is placed within the end of the core of a roll of material for supporting one end of the roll for unwinding, and spring means biasing said spindle member toward its extended position.

2. A core plug according to claim 1 wherein said supporting end portion of said spindle member has a diameter closely conforming to said predetermined diameter of said axial opening for a snug fit while still allowing relative movement, and the remainder of said spindle member having a smaller diameter.

3. A core plug according to claim 1 wherein said spring means comprises a coil spring mounted on the smaller diameter portion of said spindle member between said end wall of said body portion and said supporting portion of said spindle member.

4. A core plug according to claim 1 wherein said body portion and said spindle member are molded from a plastic material.

5. A core plug according to claim 1 wherein said body portion is a substantially hollow, cup-shaped body, open at its outer end and closed at its inner end.

6. A core plug adapted to be inserted in an end of a core of a roll of web material for supporting the roll during unwinding of the web material, said core plug comprising a cup-shaped member of molded plastic, said cup-shaped member comprising a cylindrical side wall of a diameter corresponding substantially to the internal diameter of the core of the roll of material to be supported, an end wall formed integral with said cylindrical side wall at the inner end thereof, an outwardly extending flange formed integral with said side wall at the outer end thereof, a central hub member formed integral with said end wall at one end of said hub member and extending substantially from said end wall to the other end of said side wall, said hub member having an axial opening therethrough, a plurality of spoke members formed integral with said hub member and said cylindrical side wall, and spindle means telescopically mounted in said hub member for movement axially thereof between retracted and extended positions for supporting the roll of material when extended and for ease of packaging and handling when retracted.

7. A mechanism for retaining and releasing a telescoping core plug inserted into the end of a core of a roll of web material comprising;

a core plug receiving chute having a channel for receiving the core plug, said channel having top, bottom, back and rear members;

a seating member integral with one end of said chute, said seating member having an axial opening of predetermined diameter extending longitudinally through the seating member and the back member of said chute, said axial opening being adapted to receive a core plug;

a plunger member telescopically mounted in said axial opening in said seating member for movement between extended and retracted positions and including an end portion thereof projecting beyond the outer end of said seating member;

spring means biasing said plunger member toward its extended position; and pin means for maintaining said plunger within said axial opening.

8. The mechanism according to claim 7 wherein said spring means comprises a coil spring mounted on the outer end of said plunger member between the seating member and the outer end of the plunger member whereby said plunger member is biased toward its extended position.

9. The mechanism according to claim 7 wherein said seating member is generally cylindrical.

10. The mechanism according to claim 7 wherein said channel for receiving said core plug is wider top to bottom at its receiving end than at the seating member end.

11. A roll support system for supporting a roll of web material comprising:

(a) a mechanism for retaining and releasing a roll of web material wound around a core and having a telescoping core plug adapted to fit in the each end of the core comprising; a pair of oppositely disposed core plug receiving chutes each having a channel for receiving a core plug; a seating member integral with one end of each of said chutes, said seating member having an axial opening of predetermined diameter extending longitudinally therethrough, said axial opening being adapted to receive a core plug; a plunger member telescopically mounted in said axial opening in said seating member for movement between extended and retracted positions and including an end portion thereof projecting beyond the outer end of said seating member; and spring means biasing said plunger member toward its extended position; pin means for maintaining said plunger in said axial opening; and (b) a core plug adapted to be inserted in an end of a core of a roll of web material for supporting the roll during unwinding of the web material, said core plug comprising a cup-shaped member having a cylindrical side wall of a diameter corresponding substantially to the internal diameter of the core of the roll of material to be supported, an end wall formed integral with said cylindrical side wall at the inner end thereof, an outwardly extending flange formed integral with said side wall at the outer end thereof, a central hub member formed integral with said end wall at one of said hub member and extending substantially from said end wall to the other end of said side, said hub member having an axial opening therethrough, a plurality of spoke members formed integral with said hub member and said cylindrical side wall, and spindle means telescopically mounted in said hub member for movement axially thereof between retracted and extended positions for supporting the roll of material when extended and for ease of packaging and handling when retracted.

12. A core plug for supporting one end of a roll of web material during unwinding comprising a generally cylindrical body portion having a thin circumferential side wall and an end wall formed integral with said side wall adapted to fit snugly within the end of a core about which the web material is wound, said body portion being substantially open at its outer end and closed at its inner end by an end wall formed integral with said side wall, and including a hub portion formed integral with said end wall having an axial opening of predetermined diameter extending longitudinally through said hub and said end wall and extending therefrom substantially to the outer end of said body portion and a plurality of spokes connecting said hub portion to said side wall, a spindle member telescopically mounted in said axial opening in said body portion for movement between extended and retracted positions and including a supporting end portion thereof projecting beyond the outer end of said body portion when said spindle member is in its extended position, said supporting end portion being adapted to be received in a roll support when said core plug is placed within the end of the core of a roll of material for supporting one end of the roll for unwinding, and spring means biasing said spindle member toward its extended portion.

* * * * *